US010112218B2

(12) United States Patent
Hu et al.

(10) Patent No.: US 10,112,218 B2
(45) Date of Patent: Oct. 30, 2018

(54) CHAMBER CLEANING APPARATUS AND CONTROL METHOD THEREOF

(71) Applicants: BOE TECHNOLOGY GROUP CO., LTD., Beijing (CN); HEFEI BOE OPTOELECTRONICS TECHNOLOGY CO., LTD., Anhui (CN)

(72) Inventors: Jin Hu, Beijing (CN); Xiangming Meng, Beijing (CN); Changkai Jie, Beijing (CN)

(73) Assignees: BOE TECHNOLOGY GROUP CO., LTD., Beijing (CN); HEFEI BOE OPTOELECTRONICS TECHNOLOGY CO., LTD., Anhui (CN)

( * ) Notice: Subject to any disclaimer, the term of this patent is extended or adjusted under 35 U.S.C. 154(b) by 226 days.

(21) Appl. No.: 15/085,318

(22) Filed: Mar. 30, 2016

(65) Prior Publication Data

US 2016/0288173 A1 Oct. 6, 2016

(30) Foreign Application Priority Data

Apr. 3, 2015 (CN) ..... 2015 1 0159416

(51) Int. Cl.
*B08B 1/00* (2006.01)
*B08B 9/087* (2006.01)

(52) U.S. Cl.
CPC ..... *B08B 1/006* (2013.01); *B08B 9/087* (2013.01)

(58) Field of Classification Search
CPC ..... B08B 1/006; B08B 1/008; B08B 9/087
See application file for complete search history.

(56) References Cited

FOREIGN PATENT DOCUMENTS

| | | |
|---|---|---|
| CN | 101122750 | 2/2008 |
| CN | 201026499 | 2/2008 |
| CN | 201482771 | 5/2010 |
| CN | 102814305 | 12/2012 |
| JP | 8-290139 | 11/1996 |
| JP | 2001-63880 | 3/2001 |
| JP | 2002-254039 | 9/2002 |

*Primary Examiner* — Mikhail Kornakov
*Assistant Examiner* — Natasha N Campbell
(74) *Attorney, Agent, or Firm* — Harness, Dickey & Pierce, P.L.C.

(57) ABSTRACT

The present disclosure relates to a chamber cleaning apparatus and a control method thereof. The chamber cleaning apparatus comprises: a controller for providing control signals, a supplying device, and a cleaning rail provided within the chamber. The supplying device has a first working position and a second working position, the first working position corresponding to a conveyance entrance, and the second working position corresponding to a conveyance outlet; the supplying device comprises at least two scrolls, and cleaning cloth partly on the cleaning rail; the scroll at the first working position is connected to one end of the cleaning cloth, for conveying the cleaning cloth from the conveyance entrance to the cleaning rail, and the scroll at the second working position is connected to the other end of the cleaning cloth, for collecting the cleaning cloth passing through the conveyance outlet.

15 Claims, 7 Drawing Sheets

CHAMBER CLEANING APPARATUS AND CONTROL METHOD THEREOF

CROSS-REFERENCE TO RELATED APPLICATION

This application claims the benefit and priority of Chinese Patent Application No. 201510159416.2 filed Apr. 3, 2015. The entire disclosure of the above application is incorporated herein by reference.

FIELD

The present disclosure relates to the display technical field, more particularly, to a chamber cleaning apparatus and a control method thereof.

BACKGROUND

This section provides background information related to the present disclosure which is not necessarily prior art.

The TFT-LCD (thin film transistor liquid crystal display) is a flat panel display device, and is widely applied in the high performance display field since it has the features of small size, low power consumption, no radiation and low manufacturing costs, etc.

The TFT-LCD consists of an array substrate and a color film substrate. The manufacturing process of the current TFT-LCD mainly comprises four phases, namely, color filter manufacturing, array (array substrate manufacturing) process, cell (crystal liquid cell manufacturing) process and module (module assembling) process. As an important step in TFT-LCD manufacturing, the array process usually comprises forming independent TFT array circuits on a glass substrate, with each array circuit corresponding to one display pixel respectively. Specifically, first a thin film layer may be formed on the glass substrate, then a layer of photoresist is coated on the surface of the thin film layer, and then a patterning process is performed on the above thin film layer through mask exposure, development and etching processes.

Therein, the mask exposure process is to place the substrate formed with the thin film layer and photoresist in an exposure machine, and to place a mask at the side of the substrate facing the light source, and the light source performs localized exposure on the photoresist through the mask. However, during the actual manufacturing process, since the internal cleanness of the exposure machine may be not enough, the mask may be polluted. And since the pattern of the mask is transferred onto the substrate in a 1:1 ratio, defects on the mask will easily cause defects of the thin film pattern after the exposure and transference, so as to affect the reliability of products or lower the excellence rate of products.

In the prior art, usually the internal of the chamber of the exposure machine is cleaned and maintained artificially. Thus, when workers enter into the internal of the chamber of the exposure machine, they also bring some particles into the exposure machine, so that the cleaning effect is reduced. Moreover, the efficiency of artificial cleaning and maintenance is low, reducing the product activation. In addition, the internal of the chamber of the exposure machine may also be cleaned by dust collection equipment. However, since the dust collection principle of the dust collection equipment is implemented by a strong turbulence of airflow, the internal environment factors, e.g., air pressure or temperature, of the exposure machine will be affected. Thus, when the internal temperature of the chamber of the exposure machine changes, the glass substrate will expand and contract, and deform, so the array circuits already formed on the glass substrate will be deformed; and when the internal air pressure of the chamber of the exposure machine changes, the accuracy of the mechanical members performing suction positioning on the glass substrate will be affected, thus patterning defects caused by exposure misalignment will occur.

SUMMARY

This section provides a general summary of the disclosure, and is not a comprehensive disclosure of its full scope or all of its features.

Embodiments of the present disclosure provide a chamber cleaning apparatus and a control method thereof, which can solve the problem that in cleaning technologies, the internal environment factors of the chamber of the exposure machine change and the cleaning efficiency is low.

In order to achieve the above objectives, embodiments of the present disclosure adopt the following technical solutions:

In one aspect of the embodiment of the present disclosure, there is provided a chamber cleaning apparatus for cleaning the chamber, comprising a controller for providing control signals, a supplying device, and a cleaning rail disposed within the chamber;

wherein the supplying device is connected to the starting end of the cleaning rail through a conveyance entrance, and is connected to the finishing end of the cleaning rail through a conveyance outlet;

the supplying device has a first working position and a second working position, the first working position corresponding to the conveyance entrance, and the second working position corresponding to the conveyance outlet;

the supplying device comprises at least two scrolls, and cleaning cloth partly on the cleaning rail; the scroll at the first working position is connected to one end of the cleaning cloth for conveying the cleaning cloth from the conveyance entrance to the cleaning rail; the scroll at the second working position is connected to the other end of the cleaning cloth for collecting the cleaning cloth passing through the conveyance outlet.

In another aspect of an embodiment of the present disclosure, there is provided a control method of a chamber cleaning apparatus, for controlling any of the above chamber cleaning apparatus, and the method comprises:

placing a first scroll at the first working position, and placing a second scroll at the second working position;

connecting the starting end of the first cleaning cloth on the first scroll with the second scroll; wherein the finishing end of the first cleaning cloth is connected to the first scroll;

the first scroll rotating to convey the first cleaning cloth from the conveyance entrance to the cleaning rail;

the cleaning rail unfolding the first cleaning cloth, and the first cleaning cloth cleaning the chamber along the cleaning rail;

the second scroll rotating to collect the first cleaning cloth.

The present disclosure provides a chamber cleaning apparatus and a control method thereof, wherein the chamber cleaning apparatus comprises: a controller for providing control signals, a supplying device, and a cleaning rail provided within the chamber. The supply device is connected to the starting end of the cleaning rail through a conveyance entrance, and is connected to the finishing end of the cleaning rail through a conveyance outlet; the supplying device has a first working position and a second working position, the first working position corresponding to the conveyance entrance, and the second working position corresponding to the conveyance outlet. The supplying device comprises at least two scrolls, and cleaning cloth partly on the cleaning rail; the scroll at the first working position is connected to one end of the cleaning cloth, and the scroll at the second working position is connected to the other end of the cleaning cloth. In this way, when the scroll at the first working position rotates under the control of the controller, it may convey the cleaning cloth from the conveyance entrance to the cleaning rail; the cleaning cloth is in an unfolded state on the cleaning rail, and has the function of cleaning by absorbing particles within the chamber. After cleaning for a certain time, the scroll at the second working position may rotate under the control of the controller, and collect the post-cleaning cleaning cloth at the conveyance outlet. To sum up, during this cleaning process, the cleaning cloth enters in and leaves the chamber by the rotation of the scrolls, thus avoiding the effect on the internal environment of the exposure machine caused by the turbulence generated by the vacuum cleaner in the prior art. In addition, the entire cleaning process is accomplished under the control of the controller, and thus it has high production efficiency as compared with artificial cleaning.

Further aspects and areas of applicability will become apparent from the description provided herein. It should be understood that various aspects of this disclosure may be implemented individually or in combination with one or more other aspects. It should also be understood that the description and specific examples herein are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts or features throughout the several views of the drawings.

DETAILED DESCRIPTION

Example embodiments will now be described more fully with reference to the accompanying drawings.

Figure 1:
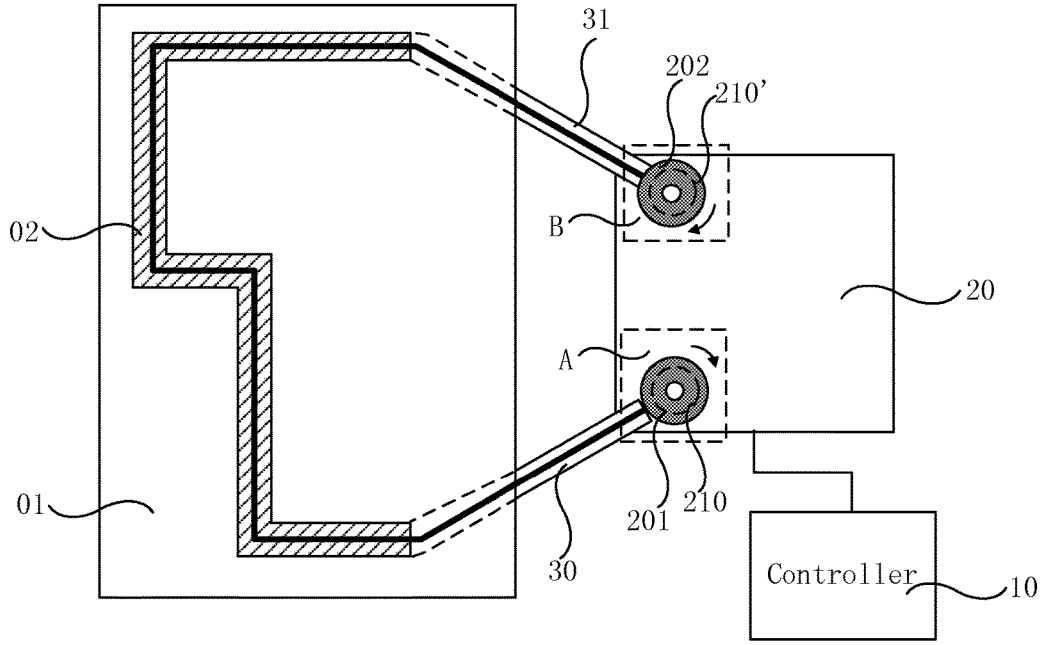
FIG. 1 is a structural schematic view of a chamber cleaning apparatus provided by an embodiment of the present disclosure.

Embodiments of the present disclosure provide a chamber cleaning apparatus for cleaning a chamber. As shown in FIG. 1, it comprises a controller 10 for providing control signals, a supplying device 20, and a cleaning rail 02 disposed within the chamber 01.

Therein, the supplying device 20 is connected to the starting end of the cleaning rail 02 through a conveyance entrance 30, and is connected to the finishing end of the cleaning rail 02 through a conveyance outlet 31.

The supplying device 20 has a first working position A and a second working position B, wherein the first working position A corresponds to the conveyance entrance 30, and the second working position B corresponds to the conveyance outlet 31.

The supplying device 20 comprises at least two scrolls, and cleaning cloth 210 partly on the cleaning rail 02. Specifically, a scroll 201 at the first working position A is connected to one end of the cleaning cloth 210, and can rotate under the control of the controller 10 to convey the cleaning cloth 210 from the conveyance entrance 30 to the cleaning rail 02. A scroll 202 at the second working position B is connected to the other end of the cleaning cloth 210, and can rotate under the control of controller 10, to collect the post-cleaning cleaning cloth 210 passing through the conveyance outlet.

It should be noted that, first, the above controller 10 may be a PC (personal computer). Thus, those skilled in the art may input a control program into the PC according to the cleaning process, so that the PC may output the corresponding control programs when the chamber cleaning apparatus performs the cleaning work, to control the respective executing parts in the chamber cleaning apparatus to perform corresponding actions.

Second, the route length from the first working position A as the starting end, through the conveyance entrance 30, cleaning rail 02 and conveyance outlet 31, to the second working position B may be referred to as the working length of the cleaning cloth 210. Thus, the length of a scroll of cleaning cloth 210 in an embodiment of the present disclosure is greater than or equal to the above working length.

Thus, when the cleaning rail 02 is covered by part of the cleaning cloth 210, the remaining part of cleaning cloth 210 may wrap around the scroll 201 at the first working position A and wrap around the scroll 202 at the second working position B, and in the conveyance entrance 30 and the conveyance outlet 31, there is part of the cleaning cloth 210 in an unfolding state. In this way, there is still part of the cleaning cloth 210 not yet used in cleaning at the first working position A, so as to avoid having to increase the step of substituting for the cleaning cloth due to too short a length of the cleaning cloth.

Third, the above controller 10 may only control the scroll 202 at the second working position B to rotate, and since the scroll 201 at the first working position A and the scroll 202 at the second working position B are connected by the cleaning cloth 210, when the scroll 202 at the second working position B rotates as the primary wheel, the scroll 201 at the first working position A may rotate as a slave wheel. Thus, repeated control is avoided and the control circuit is simplified.

Fourth, the cleaning cloth 210 in an embodiment of the present disclosure may be active carbon fiber cloth. The active carbon fiber is an activated carbon fiber; after high-temperature activation, nano-scale holes will be generated on its surface, and thus it has high absorption ability.

When the cleaning cloth 210 is active carbon fiber cloth, controller 10 may control the scroll 201 at the first working position A and the scroll 202 at the second working position B to stop rotating, and the active carbon fiber cloth having stopped movement on the cleaning rail 02 may absorb the particles around the active carbon fiber cloth in the chamber 01, so as to achieve the objective of cleaning the chamber 01. In addition, after the active carbon fiber cloth having stopped movement on the cleaning rail 02 has absorbed for a certain time, the scroll 202 at the second working position B may be controlled by the controller 10 to rotate, to make the active carbon fiber having absorbed particles to wrap around the scroll 202 at the second working position B.

An embodiment of the present disclosure provides a chamber cleaning apparatus, which may comprise: a controller for supplying control signals, a supplying device, and a cleaning trail disposed within the chamber. The supplying device is provided with a first working position and a second working position, the first working position corresponding to a conveyance entrance and the second working position corresponding to a conveyance outlet. The supplying device comprises at least two scrolls, and cleaning cloth partly on the cleaning rail; the scroll at the first working position is connected to one end of the cleaning cloth, while the scroll at the second working position is connected to the other end of the cleaning cloth. In this way, when the scroll at the first working position rotates under the control of the controller, the cleaning cloth is conveyed to the cleaning rail from the conveyance entrance, and the cleaning cloth is in an unfolded state on the cleaning rail, and achieves the function of cleaning by absorbing the particles within the chamber. After cleaning for a certain time, the scroll at the second working position may rotate under the control of the controller, and collect the post-cleaning cleaning cloth at the conveyance outlet. To sum up, during the cleaning process, the cleaning cloth enters into and leaves the chamber by the rotation of the scrolls, thus avoiding affecting the internal environment of the exposure machine brought by the air flow turbulence generated during the use of the vacuum cleaner to clean in the prior art. In addition, the entire cleaning process is accomplished under the control of the controller, and thus it has high production efficiency as compared with artificial cleaning.

In order to improve the efficiency of the cleaning apparatus, when the cleaning cloth on the scroll 201 at the first working position A has been completely separated from the scroll 201, a scroll installed with another scroll of cleaning cloth may be substituted automatically; or, when the starting end and the finishing end of the cleaning cloth on the scroll 201 at the first working position A both wrap around the scroll 202 at the second working position B, an empty scroll may be substituted automatically at the second working position B. In order to realize the automatic substitution of the scrolls, the present disclosure provides the following embodiments.

Embodiment 1

Figure 2:
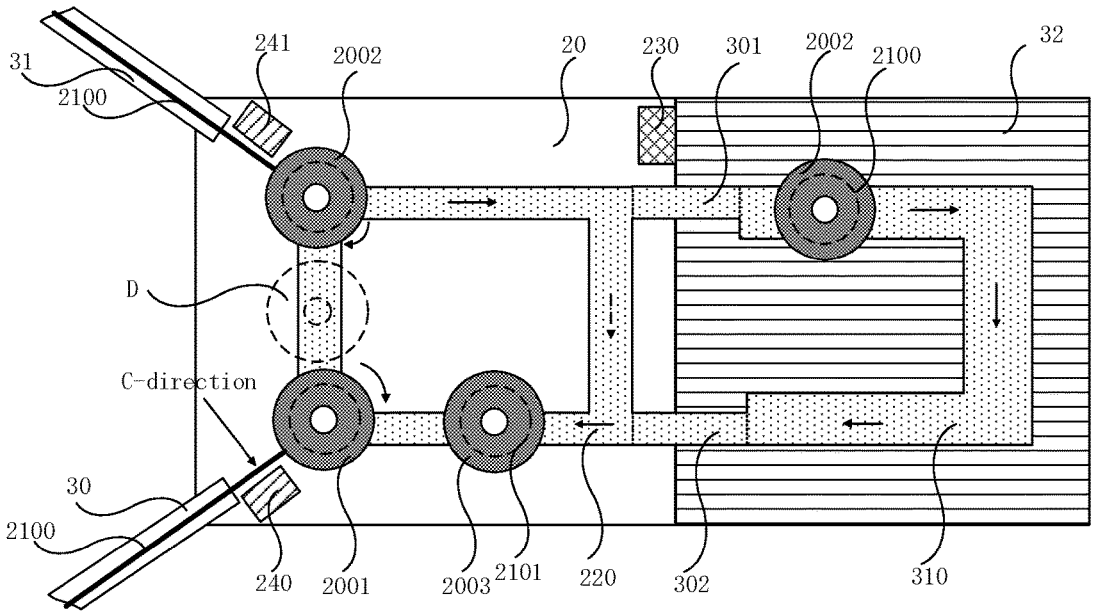
FIG. 2 is a detailed structural schematic view of the supplying device and the recovering device in FIG. 1.

As shown in FIG. 2, the supplying device 20 further comprises an annular supplying guide rail 220, and the first working position A and the second working position B are provided on the guide rail 220. The scrolls (201 and 202) are installed on the supplying guide rail 220, and may move along the supplying guide rail 220 under the control of the controller 10. Thus, a moving path may be provided for automatically substituting scrolls by the supplying guide rail 220.

In order to realize the automatic substitution of the scrolls, the supplying device 20 may further comprise a first substituting unit 240 and a second substituting unit 241.

Specifically, the first substituting unit 240 may be disposed between the conveyance entrance 30 and the first working position A, for connecting the finishing end and the starting end of adjacent two scrolls of cleaning cloths 210;

The second substituting unit 241 is disposed between the conveyance outlet 31 and the second working position B, for separating the connected finishing end and the starting end of the two scrolls of cleaning cloths 210; or for connecting the starting end of the cleaning cloth 210 at the conveyance outlet 31 to the scroll not installed with cleaning cloth 210 at the second working position B.

Figure 3:
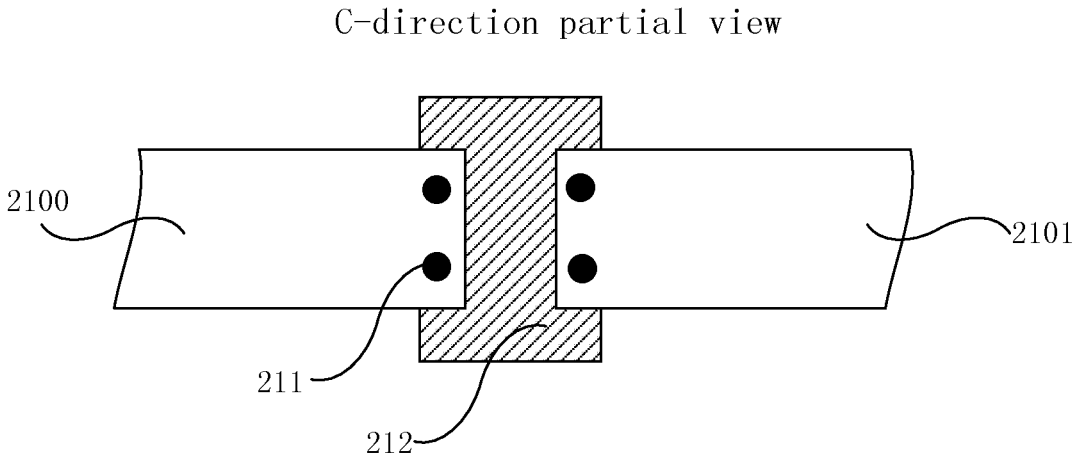
FIG. 3 is a C-direction partial view in FIG. 2.

Therein, as shown in FIG. 3, the first substituting unit 240, the second substituting unit 241 may output and recycle a second linking buckle 212 respectively to realize the end-to-end connection or end-to-end separation of the adjacent two scrolls of cleaning cloths. Specifically, a slot may be provided on the above second linking buckle 212, so that a protruding first linking buckle 211 may be engaged into the above slot, or separated from the above slot, so as to realize the end-to-end connection or end-to-end separation of the adjacent two scrolls of cleaning cloths. Or, the first linking buckle 211 may be a metal chip while the second linking buckle 212 may be a magnet chip, and the first linking buckle 211 may be stuck on the second linking buckle 212 through the first connector 240; demagnetization may be performed on the second linking buckle 212 by the second connector 241, so that the second linking buckle 212 is delinked from the first linking buckle 211.

In addition, a slot may be provided on the above scrolls, so that the second substituting unit 241 may engage the protruding first linking buckle 211 on the cleaning cloth 210 into the above slot by a mechanic hand, thus the second substituting unit 241 may connect the starting end of the cleaning cloth 210 at the conveyance outlet 31 to the scroll not installed with cleaning cloth 210 at the second working position B. Alternatively, when the first linking buckle 211 is a metal chip, a magnet chip may be provided on the above scrolls, so that the second substituting unit 241 may connect the first linking buckle 211 on the cleaning cloth 210 with the magnet chip on the scroll by a mechanical hand, so as to realize the objective that the second substituting unit 241 connects the starting end of the cleaning cloth 210 at the conveyance outlet 31 to the scroll not installed with cleaning cloth 210 at the second working position B.

Of course, the above merely illustrates the connection manners of the first substituting unit 240 and the second substituting unit 241 as an example; other manners are not repeated here one by one, but they all belong to the protection scope of the present disclosure.

The following will describe in detail the cleaning process of the chamber cleaning apparatus involving an automatic substitution process of the scrolls. In the situation that the chamber cleaning apparatus comprises three scrolls, which are first scroll 2001, second scroll 2002, and third scroll 2003, the specific cleaning process is as follows:

First, the first scroll 2001 is at the first working position A, and the second scroll 2002 is at the second working position B.

Second, the starting end of the first cleaning cloth 2100 on the first scroll 2001 is connected to the second scroll 2002; since the first cleaning cloth 2100 is installed at the first scroll 2001, the finishing end of the first cleaning cloth is connected to the first scroll 2001.

Secondly, the first scroll 2001 rotates under the control of the controller 10 or by the pulling of the second scroll 2002, to convey the first cleaning cloth 2100 from the conveyance entrance 30 to cleaning rail 02.

Next, when the finishing end of the first cleaning cloth 2100 is completely separated from the first scroll 2001, the first scroll 2001 stops rotation and moves to the second working position B along the first direction (e.g., the clockwise direction shown by the solid line arrow in FIG. 2).

It should be noted that the first direction in the embodiment of the present disclosure is adopting the clockwise direction as an example. Of course, the first direction may also be the counter-clockwise direction, and the present disclosure does not make restriction on this.

Next, the third scroll 2003 stops after moving to the first working position A along the first direction, and the first substituting unit 240 connects the starting end of the second cleaning cloth 2101 on the third scroll 2003 to the finishing end of the first cleaning cloth 2100. The third scroll 2003 rotates and transmits the second cleaning cloth 2101 to the cleaning rail 02 through the conveyance entrance 30.

Next, when the finishing end of the first cleaning cloth 2100 is separated from the starting end of the second cleaning cloth 2101 between the conveyance outlet 31 and the second working position B, and the starting end and the finishing end of the first cleaning cloth 2100 both wrap around the second scroll, the second scroll 2002 leaves the second working position B along the first direction.

Next, the first scroll 2001 stops after moving to the second working position B, and is connected to the starting end of the second cleaning cloth 2101 transmitted from the conveyance outlet 31 through the second substituting unit 241.

Finally, the first scroll 2001 rotates to collect the second cleaning cloth 2101.

It should be noted that after the first scroll 2001 leaves the first working position A and before arriving at the second working position C, the above cleaning process further comprises:

The first scroll 2001 stops after moving to a preset position D; wherein the preset position D is between the first working position A and the second working position B;

Next, when the second scroll 2002 leaves the second working position B, the first scroll 2001 at the preset position D moves to the second working B along the first direction.

In this way, the situation may be avoided that the second scroll 2002 that is working at the second working position B is affected by the first scroll 2001 moving too fast.

The above cleaning process automatically substitutes for the scrolls at the first working position A and the second working position B, thus making the cleaning process continuous, avoiding shutdown of the device caused by artificially connecting two scrolls of cleaning cloths 210, which reduces the activation ratio.

In order to improve the reutilization ratio of the cleaning cloth 210 and reduce the cost, embodiments of the present disclosure provides the following solutions.

Embodiment 2

As shown in FIG. 2, the chamber cleaning apparatus may further comprise a recovering device 32 for performing a recovering process on the cleaning cloth 210.

Specifically, in the recovering device 32, a recovering guide rail 310 may also be provided. The recovering guide rail 310 is connected to the supplying guide rail 220 through a recovering entrance 301 and a recovering outlet 302. In this way, the recovering device 32 may perform recovering process on the post-cleaning cleaning cloth 210, to make it usable repeatedly. The specific recovering process may be performing cleaning and drying processes on the cleaning cloth 210. Alternatively, when the cleaning cloth 210 is an active carbon fiber cloth, the active carbon fiber cloth may be recovered by a stripping method. The specific stripping method may include: high temperature stripping, pressure-reducing stripping, washing stripping, displacing stripping, magnetization stripping and ultrasonic wave stripping, etc.

In addition, the chamber cleaning apparatus may further comprise at least one detector (not shown in the drawings) disposed above the cleaning rail 02, or between the conveyance outlet 31 and the recovering entrance 301, or above the supplying guide rail 220, for detecting the absorption saturation degree of the cleaning cloth 210 on the cleaning rail 02. When the absorption saturation degree achieves a threshold set on the detector, it may send an alarm signal to the controller 10 to make the controller 10 to alarm.

Next will describe in detail the recovering process when the above detector is disposed.

First, the detector may detect the absorption saturation degree of the first cleaning cloth 2100.

Next, when the absorption saturation degree of the first cleaning cloth 2100 achieves the threshold set on the detector, it sends an alarm signal to controller 10.

Next, the controller receives the above alarm signal and alarms.

Next, the starting end and the finishing end of the first cleaning cloth 2100 both wrap around the second scroll 2002.

Next, the second scroll 2002 enters into the recovering guide rail 310 along the first direction through the recovering entrance 301.

Next, the recovering device 32 performs a recovering process on the cleaning cloth (i.e., the above post-cleaning first cleaning cloth 2100).

Then, the first cleaning cloth 2100 having undergone the recovering process may be supplied to the guide rail 220 through the recovering outlet 302, and move to the first working position A, so that the recovered cleaning cloth 2100 may be reused.

When the absorption saturation degree of the first cleaning cloth 2100 does not reach the threshold set on the detector, the starting end and the finishing end of the first cleaning cloth 2100 both wrap around the second scroll 2002.

Next, the second scroll 2002 moves to the first working position A along the first direction, so that the first cleaning cloth 2100 of which the absorption saturation degree does not reach the threshold set on the detector can be reused.

In this way, the production cost can be reduced by reusing the cleaning cloth.

It should be noted that, first, in an embodiment provided by the present disclosure, the supplying device 20 may further comprise a scroll driving part 230, for receiving a control signal of the controller 10, and driving the scroll to move along the supplying guide rail 220 and the recovering guide grail 310. The present disclosure does not limit the scroll driving part 230; however, the scroll driving part 230, as a power part, may be different according to different driving manners. For example, when the scroll is driven by electric power, the above scroll driving part 230 may be an electric power supply; when the scroll is driven by a mechanic force, the above scroll driving part 230 may be a hydraulic device, e.g., an hydraulic pump, a hydraulic cylinder, etc.

Second, for the above embodiment, the first scroll 200, the second scroll 2002, and the third scroll 2003 mentioned in the above description are numbered merely to describe the substitution process more clearly. However, the same one scroll may have different working positions. For example, for the first scroll 2001, when it is at the first working position B, it is scroll 201 of the chamber cleaning apparatus at the first working position; and when it is at the second working position B, it is scroll 202 of the chamber cleaning apparatus at the second working position B. The same principle also applies to the second scroll 2002 and the third scroll.

In addition, the first cleaning cloth 2100 and the second cleaning cloth 2101 mentioned in the above description are also numbered to describe the substitution process more clearly. However, the same cleaning cloth may be at different positions, e.g., when part of the first cleaning cloth 2100 is at the cleaning rail 02, the cleaning cloth is the cleaning cloth 202 partially on the cleaning cloth rail 02 in the apparatus; when the first cleaning cloth 2100 is in the recovering device 32, the first cleaning cloth 2100 is the cleaning cloth 210 on the recovering guide rail 310 in the chamber cleaning apparatus.

Third, the above merely illustrates the situation where the chamber cleaning apparatus comprises three scrolls and two scrolls of cleaning cloth as an example, and other numbers of scrolls and cleaning cloths are not repeated here, which all belong to the protection scope of the present disclosure.

The following describes in detail the cleaning rail 02 through a specific embodiment.

Embodiment 3

Figure 4:
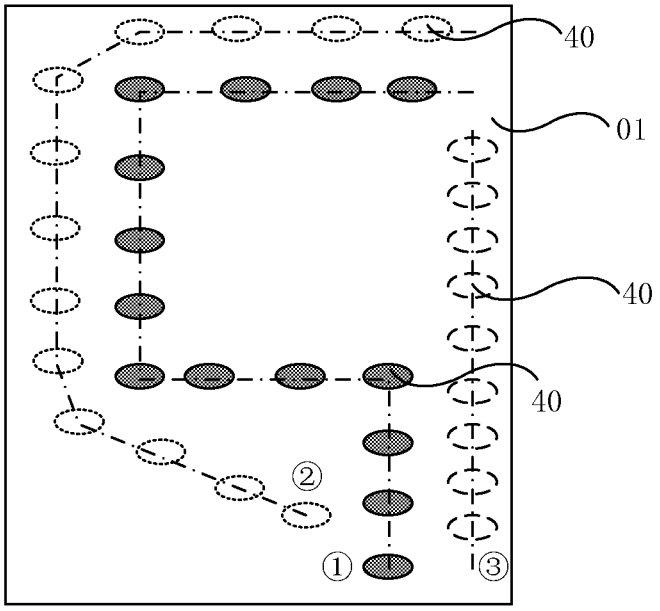
FIG. 4 is a schematic view of a preset track of the cleaning rail in FIG. 1.

The cleaning rail 02, as shown in FIG. 4, may comprise at least one position regulator 40. The position regulators 40 may be distributed within the chamber 01 along a preset track.

Therein, the above preset track refers to a movement track of the cleaning cloth 210 provided within the chamber. Its design principal lies in that during the process that the cleaning cloth 210 moves along the preset track, it cannot affect the normal operation of other devices within the chamber 01. For example, when the chamber 01 is the working chamber of an exposure machine, within the working chamber of the exposure machine, there is an object table for carrying the exposure substrate, a light source for exposure, and a mask. Thus, the above moving track needs to avoid the exposure working parts such as the object table, the light source and the mask, and the working regions, thus preventing failure of the exposure process due to the preset track overlapping with the exposure working parts and the working regions, causing the cleaning cloth 210 to shield the substrate on the object table, the mask or the light source. Of course, the above merely illustrates the preset track in the working chamber of an exposure machine as an example. The setting of preset tracks in other chambers 01 can also be obtained by the same principle, and are not repeated here.

It should be noted that the present disclosure does not limit the number of the cleaning rails 02. As shown in FIG. 4, a plurality of cleaning rails 02 can be arranged along preset tracks (1, 2, 3) according to the internal space structure of the chamber, so as to improve the cleaning efficiency of the cleaning cloth 210. Those skilled in the art may set them according to actual requirements based on the above design principle.

Figure 5:
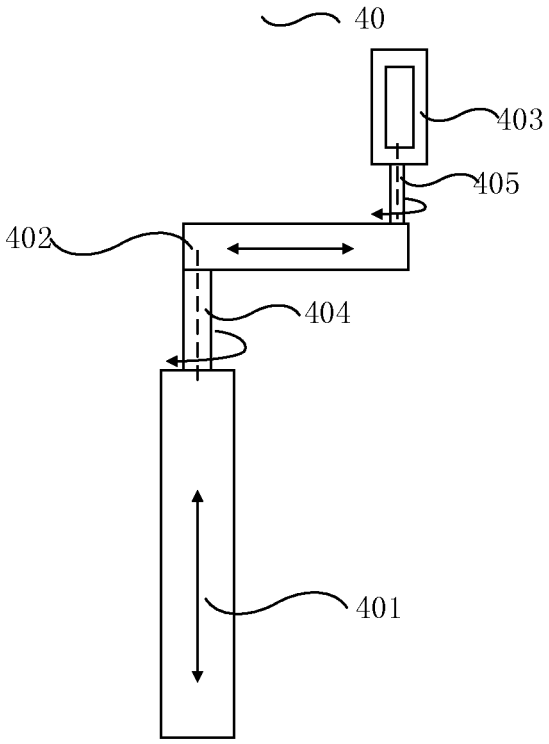
FIG. 5 is a detailed structural schematic view of the position regulator 40 in FIG. 4.

Specifically, the position regulator 40, as shown in FIG. 5, may comprise a vertical regulating part 401 disposed in a vertical direction, a horizontal regulating part disposed in a horizontal direction, and a guiding part 403 disposed in the vertical direction for supporting the cleaning cloth 210.

Figure 6:
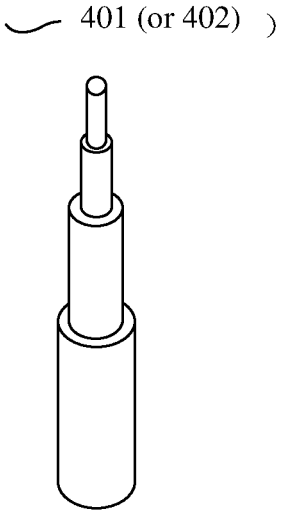
FIG. 6 is a detailed structural schematic view of the horizontal regulating part and the vertical regulating part in FIG. 5.

Therein the vertical regulating part 401 and the horizontal regulating part 402 are connected through a first shaft 404 disposed in the vertical direction, and the first shaft 404 may be used to drive the horizontal regulating part 402 to rotate with the vertical regulating part 401 as the center. When the vertical regulating part 401 and the horizontal regulating part 402 are an extension rod as shown in FIG. 6, the center of the above vertical regulating part 401 may be the central line of the extension rod. Therein, the above extension rod may be a plurality of cylinders with the same central line nested one by one according to their diameters.

Since the length of the vertical regulating part 401 is adjustable in the vertical direction, the length of the horizontal regulating part 402 is adjustable in the horizontal direction, by rotating the horizontal regulating part 402 and regulating the length of the horizontal regulating part 402, the cleaning range in the horizontal direction of the cleaning cloth 210 on the guiding part 403 can be expanded. Moreover, when the length of the vertical regulating part 401 is adjusted, the cleaning range in the vertical direction of the cleaning cloth 210 on the guiding part 403 can be expanded.

It should be noted that first, the above horizontal direction and the vertical direction are two mutually perpendicular directions. Moreover, the above horizontal direction and vertical direction are two relative concepts; when FIG. 6 is rotated by 90 degrees, the length of the vertical regulating part 401 would be adjusted along the horizontal direction, and the length of the horizontal regulating part 402 would be adjusted along the vertical direction.

Secondly, when the chamber 01 is the working chamber of an exposure machine, the length regulating range of the above vertical regulating part 401 or the horizontal regulating part 402 may be greater than or equal to 0.1 m, and smaller than or equal to 3 m. When the length regulating size is smaller than 0.1 m, since the regulating size is too small, the minimum size of the vertical regulating part 401 or the horizontal regulating part 402 in their own extended or contracted states may be set very small, so that the manufacturing difficulty and precision of the vertical regulating part 401 or the horizontal regulating part 402 have to be enhanced, which is not good for reducing the production cost. In addition, when the length regulating size is greater than 3 m, since the chamber 01 also has other parts, after the vertical regulating part 401 or the horizontal regulating part 402 is adjusted to the maximum size, they will easily interfere with the normal operations of the other parts.

In addition, the guiding part 403 may be connected to the horizontal regulating part 402 through a second shaft 405 disposed in the vertical direction, and rotate by the driving of the second shaft 405. Therein the above guiding part 403 may be, as shown in FIG. 5, a frame provided with a hallow region in the center, so that the cleaning cloth 210 may pass through the guiding part 403 through the above hallow region, so that the guiding part 403 will not affect the transmission of the cleaning cloth 210 while supporting the cleaning cloth 210.

In this way, during the length adjustment of the vertical regulating part 401 and the vertical regulating part 402, since the guiding part 403 can be rotated, the cleaning cloth 210 can maintain an unfolded state, avoiding its twist causing the cleaning or absorption effects to be reduced.

The following describes in detail a specific regulating process of the position regulator 40.

First, when the cleaning cloth 210 unfolds on the cleaning rail 02, the controller 10 sends cleaning parameters to the position regulator 40. For example, when the cleaning cloth 210 is active carbon fiber cloth, the cleaning parameters may be related to the absorption saturation degree of the active carbon fiber cloth and the absorption area.

Next, according to the cleaning parameters, the vertical regulating part 401 of the position regulator 40 extends and contracts in the vertical direction, bringing the cleaning cloth 210 on the guiding part 403 to move in the vertical direction.

Then, according to the cleaning parameter, the horizontal regulating part 402 of the position regulator 40 rotates with the vertical regulating part 401 as the center, and extends and contracts in the horizontal direction, bringing the cleaning cloth 210 on the guiding part 403 to move in the horizontal direction.

In this way, the maximum cleaning range and optimal cleaning effect can be achieved within the range of the cleaning capability of the cleaning cloth 210.

Figure 7:
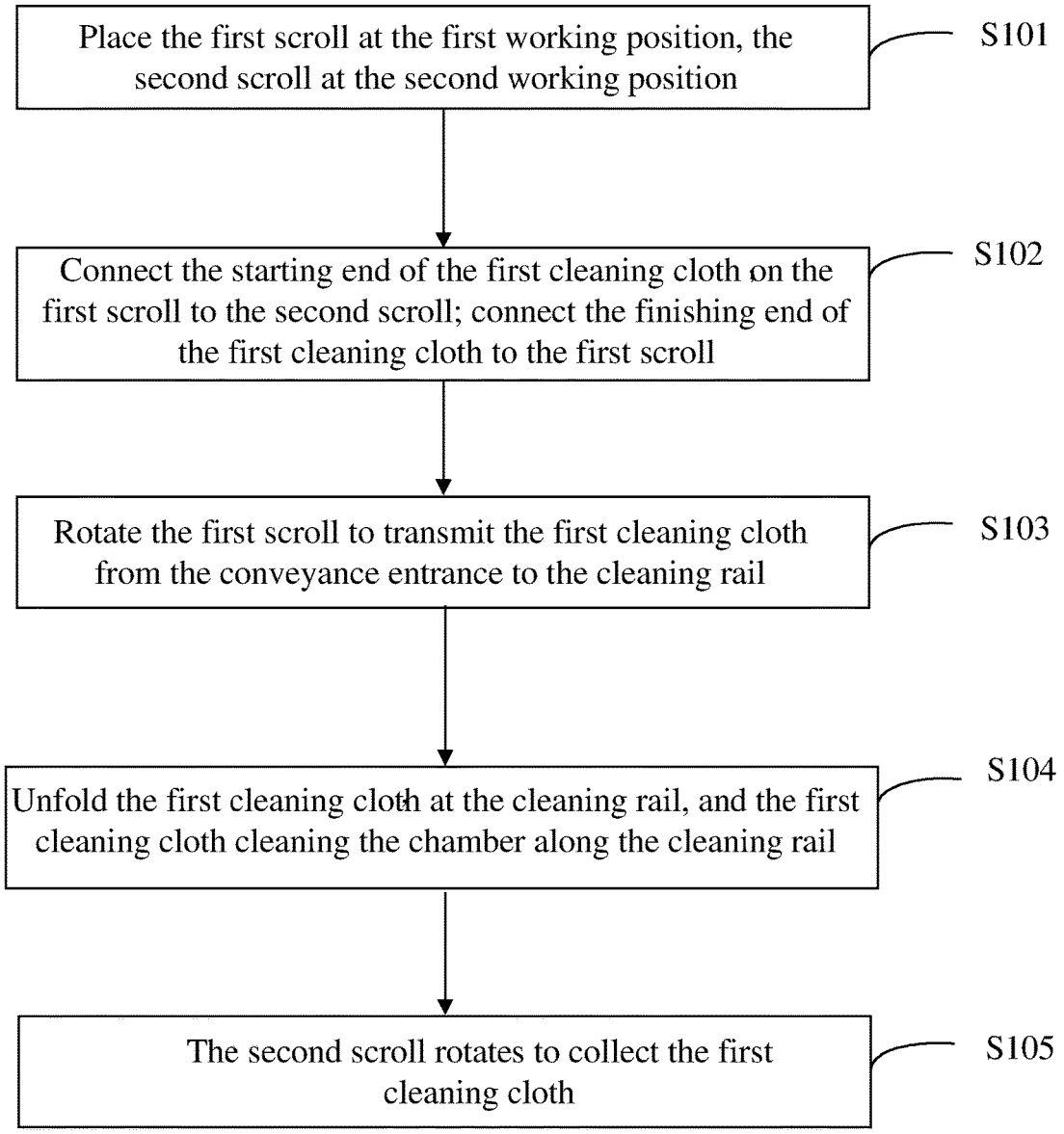
FIG. 7 is a flow chart of a control method of a chamber cleaning apparatus provided by an embodiment of the present disclosure.

An embodiment of the present disclosure provides a control method of a chamber cleaning apparatus, for controlling any one of the above chamber cleaning apparatus; as shown in FIG. 7, the method may comprise:

S101, as shown in FIG. 3, the first scroll 2001 is disposed at the first working position A, and the second scroll 2002 is disposed at the second working position B.

S102, the starting end of the first cleaning cloth 2100 on the first shaft 2001 is connected to the second scroll 2101; wherein, since the first cleaning cloth 2100 is installed on the first scroll 2002, the finishing end of the first cleaning cloth 2100 is connected to the first scroll;

S103, the first scroll 2001 rotates to transmit the first cleaning cloth 2100 from the conveyance entrance 30 to the cleaning rail 02.

S104, the cleaning rail 02 unfolds the first cleaning cloth, and the first cleaning cloth 2100 cleans the chamber 01 along cleaning rail 02.

S105, the second scroll 2002 rotates to collect the first cleaning cloth 2100.

An embodiment of the present disclosure provide a control method of a chamber cleaning apparatus, comprising: first the first scroll is disposed at the first working position and the second scroll is disposed at the second working position; then, the starting end of the first cleaning cloth on the first scroll is connected to the second scroll; the finishing end of the first cleaning cloth is connected to the first scroll; next, the first scroll rotates to transmit the first cleaning cloth from the conveyance entrance to the cleaning rail; next, the cleaning rail unfolds the first cleaning cloth, and the first cleaning cloth cleans the chamber along the cleaning rail; finally, the second scroll rotates to collect the first cleaning cloth. In this way, when the scroll at the first working position rotates under the control of the controller, the cleaning cloth may be transmitted to the cleaning rail from the conveyance entrance, and the cleaning cloth is in an unfolded state on the cleaning rail, and achieves the cleaning function by absorbing particles in the chamber. After cleaning for a certain time, the scroll at the second working position may rotate under the control of the controller, and may collect the post-cleaning cleaning cloth at the conveyance outlet. To sum up, during the cleaning process, the cleaning cloth enters into and leaves the chamber by the rotation of the scrolls, and thus avoid the influences to the internal environment factors of the exposure machine that may be caused by the turbulences generated using a vacuum cleaner in the prior art. And the entire cleaning process is accomplished under the control of the controller, and thus it has high cleaning efficiency as compared with artificial cleaning.

Embodiment 4

Figure 8:
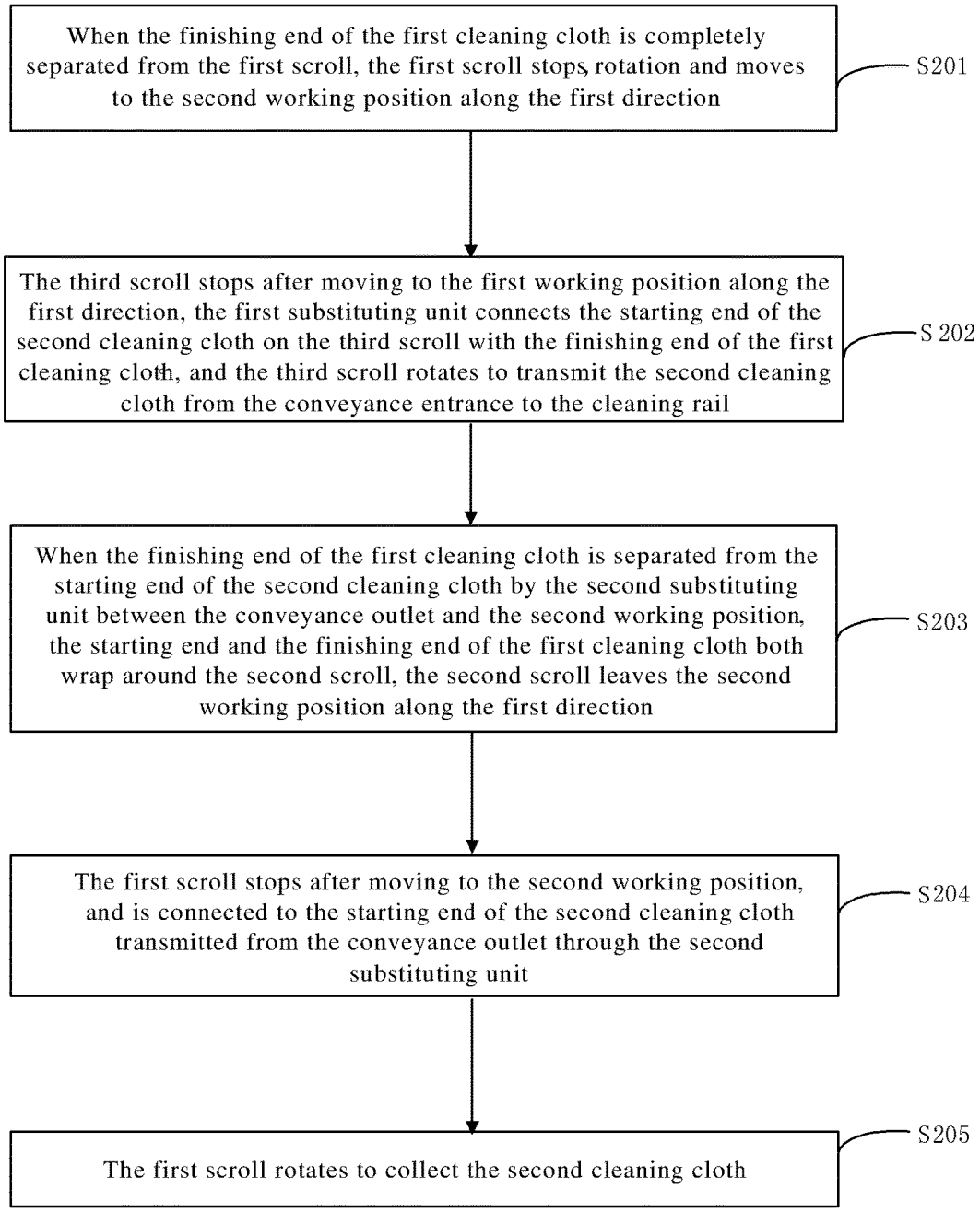
FIG. 8 is a flow chart of a control method of a chamber cleaning apparatus provided with a scroll substitution process provided by an embodiment of the present disclosure.

In order to improve the efficiency of the cleaning apparatus, when the cleaning cloth on the scroll 201 at the first working position A is completely separated from the scroll 201, a scroll installed with another scroll of cleaning cloth can be substituted automatically; or when the starting end and the finishing end of the scroll 201 at the first working position both wrap around the scroll 202 at the second working position B, it is needed to automatically substitute an empty scroll at the second working position B. The chamber cleaning control method for realizing the above automatic substitution process of the scroll provided by an embodiment of the present disclosure may, after the above step S103, and as shown in FIG. 8, further comprise:

S201, when the finishing end of the first cleaning cloth 2100 is completely separated from the first shaft 2001, the first scroll 2001 stops rotation and moves towards the second working position B along the first direction (the clockwise direction shown by the solid line arrow in FIG. 2).

It should be noted that the first direction in the embodiment of the present disclosure takes the clockwise direction as an example. Of course, the first direction may also be the counter-clockwise direction.

S202, the third scroll 2003 stops after moving to the first working position A along the first direction, and the first substituting unit 240 connects the starting end of the second cleaning cloth 2101 on the third shaft 203 to the finishing end of the first cleaning cloth 2100. The third scroll 2003 rotates and transmits the second cleaning cloth 2101 from the conveyance entrance 30 to the cleaning rail 02.

S203, when the finishing end of the first cleaning cloth 2100 and the starting end of the second cleaning cloth 2011 are separated by the second substituting unit 241 between the conveyance outlet 31 and the second working position B, and the starting end and the finishing end of the first cleaning cloth 2100 both wrap around the second scroll, the second scroll 2002 leaves the second working position B along the first direction.

S204, the first scroll 2001 stops after moving to the second working position B, and is connected with the starting end of the second cleaning cloth 2101 transmitted from the conveyance outlet 31 by the second substituting unit 241.

S205, the first scroll 2001 rotates to collect the second cleaning cloth 2101.

It should be noted that, after the first scroll 2001 leaves the first working position A and before arriving at the second working position B, the above cleaning process further comprises:

First, the first scroll 2001 stops after moving to a preset position D; wherein the preset position D is between the first working position A and the second working position B;

Next, after the second scroll 2002 leaves the second working position B, the first scroll 2001 at the preset position D moves to the second working position B along the first direction.

Thus, the situation may be avoided that the first scroll 2001 moves too fast to affect the second scroll 2002 that is working at the second working position B.

The above cleaning process is made to be a continuous cleaning process by automatically substituting the scrolls at the first working position A and the second working position B, avoiding device shutdown and reducing of the activation ratio caused by connecting two scrolls of cleaning cloths 210 artificially.

Embodiment 5

In order to improve the reutilization ratio of the cleaning cloth 210 and reduce the cost, the control method of the chamber cleaning apparatus further comprises:

First, the recovering device 32 performs a recovering process on the cleaning cloth on the recovering guide rail 310.

Then, the cleaning cloth having undergone the recovering process is transmitted to the supplying guide rail 220 through the recovering guide rail 310. Thus, the recovering device 32 may perform a recovering process on the post-cleaning cleaning cloth 210, to make it usable repeatedly. The specific recovering process may be cleaning and drying the cleaning cloth 210. Alternatively, when the cleaning cloth 210 is active carbon fiber cloth, the active carbon fiber cloth may be recovered by a stripping method. The specific stripping method may be: high temperature stripping, pressure-reducing stripping, washing stripping, displacing stripping, magnetizing stripping, ultra-sonic wave stripping, etc.

Figure 9:
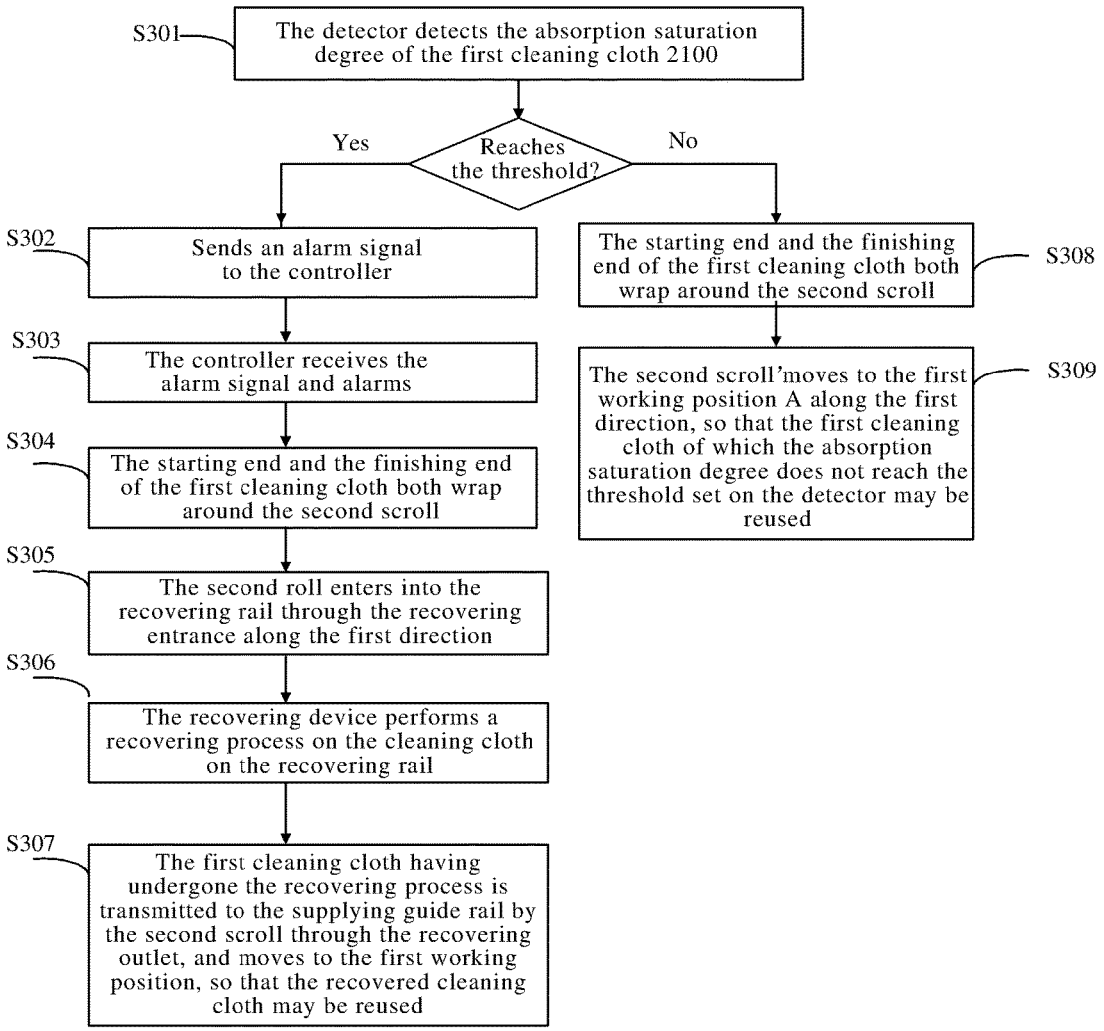
FIG. 9 is a flow chart of a control method of a chamber cleaning apparatus relating to a detection and alarming process provided by the embodiment of the present disclosure.

In addition, when the chamber cleaning apparatus comprises at least one detector disposed above the cleaning rail 02, or between the transmit outlet 31 and the recovering entrance 301, or above the supplying guide rail 220, the above method, as shown in FIG. 9, may comprise:

S301, the detector detects the absorption saturation degree of the first cleaning cloth 2100, to detect whether the absorption saturation degree of the first cleaning cloth 2100 reaches a threshold set on the detector.

S302, when the absorption saturation degree of the first cleaning cloth 2100 reaches the threshold set on the detector, it sends an alarm signal to the controller 10.

S303, the controller receives the above alarm signal and alarms.

S304, the starting end and the finishing end of the first cleaning cloth 2100 both wrap around the second scroll 2002.

S305, the second scroll 2002 enters into the recovering guide rail 310 along the first direction.

S306, the recovering device 32 performs a recovering process on the cleaning cloth (i.e., the above post-cleaning cleaning cloth 2100) on the recovering guide rail 301.

S307, the first cleaning cloth 2100 having undergone the recovering process may be transmitted to the supplying guide rail 220 through the recovering outlet by the second scroll 2002, and move to the first working position A, so that the recovered cleaning cloth 2100 may be reused.

S308, when the absorption saturation degree of the first cleaning cloth 2100 does not reach the threshold set on the detector, the starting end and the finishing end of the first cleaning cloth 2100 both wrap around the second scroll 2002.

S309, the second scroll 2002 moves to the first working position A along the first direction, so that the first cleaning cloth 2100 of which the absorption saturation degree does not reach the threshold set on the detector may be reused.

In this way, the production costs can be reduced by reusing the cleaning cloth.

It should be noted that, first, for the above embodiment, the first scroll 2001, the second scroll 2002 and the third scroll 2003 mentioned in the above process are merely numbered for describing the substitution process more clearly. Therein, the same one scroll may have different working positions. For example, as for the first scroll 2001, when it is at the first working position A, it is the scroll 201 at the first working position in the chamber cleaning apparatus; when it is at the second working position B, it is the scroll 202 at the second working position in the chamber cleaning apparatus. The same principle applies to the second scroll 2002 and the third scroll 2003 as well.

In addition, the first cleaning cloth 2100 and the second cleaning cloth 2101 mentioned in the above description are also numbered to describe the substitution process clearly. Therein, the same one cleaning cloth may be at different positions. For example, when part of the first cleaning cloth 2100 is on the cleaning rail 02, the cleaning cloth may be cleaning cloth 202 partially on the cleaning cloth rail 02 in the device; when the first cleaning cloth 2100 is in the recovering device 02, the first cleaning cloth 2100 is the cleaning cloth 210 on the recovering guide rail 310 in the chamber cleaning apparatus.

Second, the above merely illustrates the chamber cleaning apparatus comprising three scrolls and two scrolls of cleaning cloth in the chamber cleaning apparatus as an example, and other numbers of scrolls and scrolls of cleaning cloth are not repeated here, but they all belong to the protection scope of the present disclosure.

Embodiment 6

Figure 10:
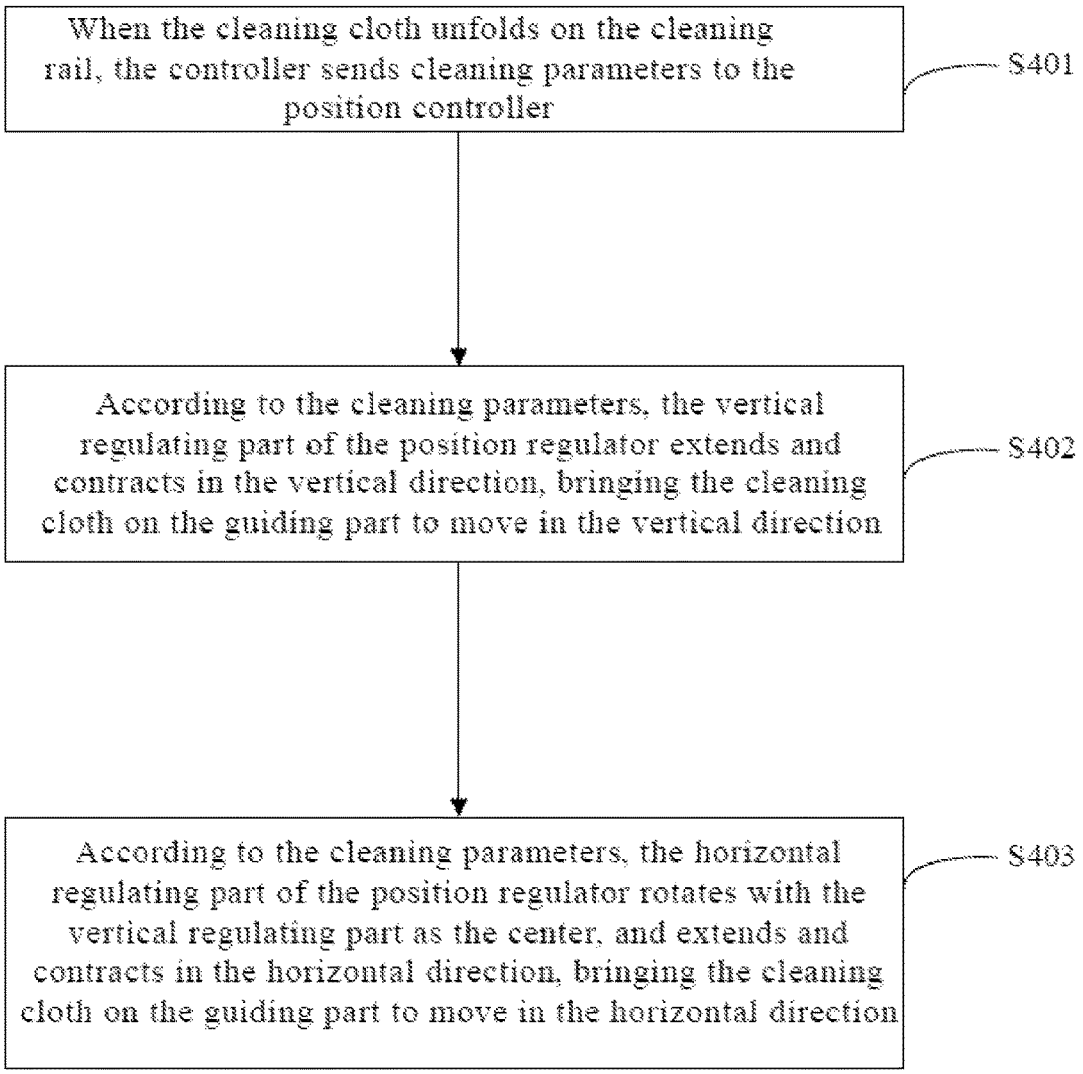
FIG. 10 is a flow chart of a regulating method of a position regulator provided by an embodiment of the present disclosure.

When the cleaning rail 02 comprises position regulators 40, step S104, as shown by FIG. 10, may comprise:

S401, when the cleaning cloth 210 unfolds on the cleaning rail 02, the controller 10 sends cleaning parameters to the position regulators 40. For example, when the cleaning cloth 210 is active carbon fiber cloth, the cleaning parameters may be related to the absorption saturation degree required by the active carbon fiber cloth, and the absorption area.

S402, according to the cleaning parameters, the vertical regulating part 401 of the position regulator 40 extends and contracts in the vertical direction, bringing the cleaning cloth 210 on the guiding part 403 to move in the vertical direction.

S403, according to the cleaning parameters, the horizontal regulating part 402 of the position regulator 40 rotates with the vertical regulating part 401 as the center, and extends and contracts in the horizontal direction, bringing the cleaning cloth 210 on the guiding part 403 to move in the horizontal direction.

Thus, the maximum cleaning range and optimal cleaning effect may be achieved within the range of the cleaning capability of the cleaning cloth 210.

Those of ordinary skill in the art may understand that all or part of the steps for realizing the above method embodiments may be accomplished by hardware related to program instructions; the program may be stored in a computer readable storage medium, and the program executes the steps included in the above method embodiments when being executed; and the storage mediums includes: various mediums that can store program code, such as ROM, RAM, disk or optical disk and the like.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A chamber cleaning apparatus for cleaning a chamber, the chamber cleaning apparatus comprising a controller for providing control signals, a supplying device, and a cleaning rail positioned in the chamber;

the supplying device connected to a starting end of the cleaning rail through a conveyance entrance, and a finishing end of the cleaning rail through a conveyance outlet;

the supplying device having a first working position and a second working position, the first working position corresponding to the conveyance entrance, and the second working position corresponding to the conveyance outlet;

the supplying device comprising at least two scrolls, and a cleaning cloth partly on the cleaning rail, the at least two scrolls including a scroll at the first working position and a scroll at the second working position, the scroll at the first working position connected to one end of the cleaning cloth for conveying the cleaning cloth from the conveyance entrance to the cleaning rail, and the scroll at the second working position connected to the other end of the cleaning cloth for collecting the cleaning cloth passing through the conveyance outlet.

2. The chamber cleaning apparatus of claim 1, wherein the supplying device further comprises an annular supplying guide rail, wherein the first working position and the second working position are disposed on the supplying guide rail, and wherein the scrolls are installed on the supplying guide rail, and move along the supplying guide rail under the control of the controller.

3. The chamber cleaning apparatus of claim 2, further comprising a recovering device including a recovering guide rail is provided connected to the supplying guide rail through a recovering entrance and a recovering outlet, wherein the recovering device is for performing a recovering process on the cleaning cloth located on the recovering guide rail.

4. The chamber cleaning apparatus of claim 3, wherein the supplying device further comprises a scroll driving part for receiving control signals from the controller, and driving the scroll to move along the supplying guide rail and the recovering guide rail.

5. The chamber cleaning apparatus of claim 1, wherein the supplying device further comprises a first substituting unit and a second substituting unit;

wherein the first substituting unit is disposed between the conveyance entrance and the first working position for connecting a finishing end and a starting end of two adjacent scrolls of cleaning cloth; and wherein the second substituting unit is disposed between the conveyance outlet and the second working position for separating a finishing end from a starting end of the two connected scrolls of cleaning cloth or for connecting a starting end of the cleaning cloth at the conveyance outlet to the scroll at the second working position not installed with cleaning cloth.

6. The chamber cleaning apparatus of claim 1, wherein the cleaning rail comprises at least one position regulator, and the at least one position regulator is distributed within the chamber along a preset track;

wherein the position regulator comprises a vertical regulating part disposed in the vertical direction, a horizontal regulating part disposed in the horizontal direction, and a guiding part disposed in the vertical direction and supporting the cleaning cloth;

wherein the vertical regulating part is connected to the horizontal regulating part through a first shaft disposed in the vertical direction, and the first shaft is for driving the horizontal regulating part to rotate about the vertical regulating part;

wherein the length of the vertical regulating part is adjustable in the vertical direction, and the length of the horizontal regulating part is adjustable in the horizontal direction; and wherein the guiding part is connected to the horizontal regulating part through a second shaft disposed in the vertical direction, and configured to rotate when the second shaft is pulled.

7. The chamber cleaning apparatus of claim 6, wherein:

the length of the vertical regulating part or the horizontal regulating part ranges from 0.1 m to 3 m.

8. The chamber cleaning apparatus of claim 1, further comprising a detector for detecting an absorption saturation degree of the cleaning cloth on the cleaning rail, and sending an alarm signal to the controller if the absorption saturation degree reaches a threshold set on the detector.

9. A method for operating a chamber cleaning apparatus comprising a controller for providing control signals, a supplying device, and a cleaning rail positioned in the chamber, the supplying device connected to a starting end of the cleaning rail through a conveyance entrance and a finishing end of the cleaning rail through a conveyance outlet, the supplying device having a first working position and a second working position, the first working position corresponding to the conveyance entrance, and the second working position corresponding to the conveyance outlet, the method comprising:

placing a first scroll of the supplying device at the first working position and placing a second scroll of the supplying device at the second working position;

connecting a starting end of a first cleaning cloth on the first scroll to the second scroll, wherein a finishing end of the first cleaning cloth is connected to the first scroll;

rotating the first scroll to convey the first cleaning cloth from the conveyance entrance to the cleaning rail;

unfolding the first cleaning cloth, and cleaning, with the first cleaning cloth, the chamber along the cleaning rail; and rotating the second scroll to collect the first cleaning cloth.

10. The method of claim 9, wherein the supplying device comprises an annular supplying guide rail and wherein the first working position and the second working position are disposed on the supplying guide rail, the method further comprising installing the first scroll and the second scroll on the supplying guide rail and moving the first scroll and the second scroll along the supplying guide rail under the control of the controller.

11. The method of t claim 10, wherein after the first scroll rotates to convey the first cleaning cloth from the conveyance entrance to the cleaning rail, the method further comprises:

when the finishing end of the first cleaning cloth is completely separated from the first scroll, stopping rotation of the first scroll and moving the first scroll to the second working position along a first direction;

stopping a third scroll of the supplying device after it is moved to the first working position along the first direction, connecting, with a first substituting unit, a starting end of a second cleaning cloth on the third scroll to the finishing end of the first cleaning cloth, and rotating the third scroll and transmitting the second cleaning cloth from the conveyance entrance to the cleaning rail;

when the finishing end of the first cleaning cloth is separated from the starting end of the second cleaning cloth between the conveyance outlet and the second working position by a second substituting unit, wrapping the starting end and the finishing end of the first cleaning cloth around the second scroll, and moving the second scroll from the second working position along the first direction;

stopping the first scroll it is moved the second working position, and connecting the first scroll to the starting end of the second cleaning cloth conveyed from the conveyance outlet through the second substituting unit; and rotating the first scroll to collect the second cleaning cloth.

12. The method of claim 11, wherein after the first scroll moves from the first working position and before the first scroll arrives at the second working position, the method further comprises:

stopping the first scroll after it is moved to a preset position, wherein the preset position is between the first working position and the second working position; and after the second scroll moves from the second working position, moving the first scroll at the preset position to the second working position along the first direction.

13. The method of claim 11, further comprising:

performing a recovering process on the first cleaning cloth located on a recovering guide rail; and conveying the first cleaning cloth after the recovering process to the supplying guide rail through the recovering guide rail.

14. The control method of claim 13, further comprising:

detecting an absorption saturation degree of the first cleaning cloth;

when the absorption saturation degree of the first cleaning cloth reaches a preset threshold, sending an alarm signal to the controller, wrapping the starting end and the finishing end of the first cleaning cloth around the second scroll, moving the second scroll onto the recovering guide rail through a recovering entrance along the first direction, performing a recovering process on the second cleaning cloth on the recovering guide rail; and when the absorption saturation degree of the first cleaning cloth does not reach the preset threshold, wrapping the starting end and the finishing end of the first cleaning cloth around the second scroll, and moving the second scroll to the first working position along the first direction.

15. The method of claim 9, wherein unfolding the first cleaning cloth and cleaning the chamber along the cleaning rail comprises:

sending, via the controller, cleaning parameters to a position regulator;

based on the cleaning parameters, extending and contracting a vertical regulating part of the position regulator in the vertical direction and moving the first cleaning cloth in the vertical direction; and based on the cleaning parameters, rotating a horizontal regulating part of the position regulator about the vertical regulating part, extending and contracting the horizontal regulating part in a horizontal direction and moving the first cleaning cloth in the horizontal direction.

* * * * *